United States Patent [19]

Brandenberger et al.

[11] Patent Number: 4,601,751

[45] Date of Patent: Jul. 22, 1986

[54] PROCESS FOR THE PRODUCTION OF CAST IRON CONTAINING SPHERICAL GRAPHITE

[75] Inventors: Urs Brandenberger, Dachsen; Ivo Henych, Schaffhausen; Klaus Hornung, Stein am Rhein; Werner Menk, Schaffhausen, all of Switzerland

[73] Assignee: Georg Fischer AG, Schaffhausen, Switzerland

[21] Appl. No.: 757,885

[22] Filed: Jul. 23, 1985

[30] Foreign Application Priority Data

Jul. 26, 1984 [CH] Switzerland ..... 3624/84

[51] Int. Cl.[4] ..... C21C 7/02

[52] U.S. Cl. ..... 75/130 R; 75/53; 75/58

[58] Field of Search ..... 75/53, 58, 130 R, 130 A, 75/130 AB

[56] References Cited

U.S. PATENT DOCUMENTS 2,867,555 1/1959 Curry ..... 75/130 A
3,309,197 3/1967 Kusaka ..... 75/130 R
3,415,307 12/1968 Schuh ..... 75/130 R
4,385,030 5/1983 Dremann ..... 75/130 A

*Primary Examiner*—Peter D. Rosenberg
*Attorney, Agent, or Firm*—Marmorek, Guttman & Rubenstein

[57] ABSTRACT

A process for the production of cast iron containing spheroidal graphite is disclosed. In the process, the iron melt, which contains sulphur, is treated with metallic magnesium, forming unstable MgS as a by-product. By the addition of CaSi, the sulphur contained in the MgS present in the slag is converted into stable CaS. As a result, the free sulphur which is released upon decomposition of MgS when the melt is allowed to stand for a fairly long time is prevented from going back again into the melt, reacting there with the dissolved magnesium, and forming MgS once again.

Through the stabilization of the sulphur in the form of CaS in the slag itself, resulphurization is effectively prevented. The slag can remain on the melt surface for a longer time than hitherto. The slag provides a heat-insulating effect, so that even longer standing times which are possibly required in certain production processes, can be utilized.

9 Claims, No Drawings

PROCESS FOR THE PRODUCTION OF CAST IRON CONTAINING SPHERICAL GRAPHITE

BACKGROUND OF THE INVENTION

The present invention relates to a process for the production of cast iron containing spheroidal graphite. In this process, iron melt is treated with metallic magnesium to form the cast iron containing spheroidal graphite.

In the production of cast iron containg spheroidal graphite according to the process known as the converter process, a slag is formed which contains on the order of 5% by weight sulphur in the form of magnesium sulphide (MgS). At the usual treatment temperatures of between 1450 and 1550° C., atmospheric oxygen can oxidize the magnesium sulphide. Thus, magnesium oxide is formed and the free sulphur strays back into the melt to form once again magnesium sulphide with the magnesium metal already dissolved therein. This process is called resulphurization and can, in extreme cases, lead to degeneration of the spherolites of graphite.

The methods used until know for overcoming the problem of resulphurization are unsatisfactory.

In a conventional process for producing cast iron, a slag dam is erected to hold back the slag. However, the slag dam only partially holds back the slag when the melt is being emptied from the converter into a transport vessel. This method requires a very costly cleaning of the converter.

In another known process, the iron melt is emptied together with the slag into a transport vessel. The deslagging of the melt does not take place until they are in the transport vessel. The particular disadvantage of this process consists in the fact that during this process, resulphurization can still take place and is further encouraged by recasting. In addition, the deslagged melt cools down very quickly and casting of the melt has to take place without delay.

It is an object of the present invention to provide a process for producing cast iron containing spherical graphite wherein a stabilizing effect on the sulphur content in the converter slag is achieved so as to reduce or suppress resulphurization.

SUMMARY OF THE INVENTION

This and other objects can be achieved by means of the present invention which provides a process for producing cast iron containg spheroidal graphite, comprising adding metallic magnesium to a pool of molten iron having sulfur therein. As in result, molten cast iron containg spheroidal graphite and a slag containing MgS are formed. To this mixture, is added a sulphur stabilizing agent whereby resulphurization of the cast iron is prevented.

In a preferred embodiment, the sulphur stabilizing agent is a calcium containing substance, such as calcium silicon (CaSi), which is added in an amount ranging from 0.05 to 1% by weight of the molten iron. When CaSi is added to the slag, calcium sulphide, which is thermodynamically more stable than magnesium sulphide, is formed. Thus, free sulphur is not formed and resulphurization of the iron melt is suppressed.

Other preferred embodiments are described herein below.

DETAILED DESCRIPTION OF PREFERRED EMBODIMENTS

Since the discovery that iron containg spherical graphite can be produced by introducing magnesium into cast iron melts, many different magnesium treatment processes have been developed. One process, known as the +GF+ pure magnesium-converter process, developed by the assignee of the present invention, is advantageously used when, in an acid cupola furnace, molten iron with a fairly high sulphur content is on the one hand desulphurized in one operation by means of metallic magnesium, and, on the other hand, is converted into cast iron with spherical graphite. It is thus possible to produce cast iron with spherical graphite without prior desulphurizing of the iron melt. In this process, the sulphur dissolved in the iron reacts with the metallic magnesium to form magnesium sulphide. MgS therefore precipitates out as a reaction product, is separated by agitation of the bath, and floats as a granular slag component on the bath surface in the converter.

As stated previously, the MgS phase is relatively unstable. Normally, the slag should be removed as soon as possible after the termination of the course of the reacion, but this is not always immediately possible, so that specific standing times have to be taken into account. Because of its instability, however, MgS can be oxidized on the transport path to the casting location, and the released sulphur diffuses back into the melt. This results in renewed formation of magnesium sulphide by the reaction of the released sulphur with the magnesium already dissolved in the melt. The magnesium necessary for the formation of graphite spheroids is thereby reduced, and the finely dispersed MgS pollutes the melt.

In the case of thick-walled castings and centrifugal casting pipes, it has been discovered that in extreme cases, resulphurization has led to problems in formation of the spheroids due to segregation of the MgS.

By means of the present invention, resulphurization from the slag is prevented by stabilizing the sulphur in the slag. At the same time, the MgS particles present in the melt are stabilized so as to prevent degeneration of the spheroids due to segregation of the MgS.

The stabilizing takes place first of all by means of the addition of a sulphur stabilizing agent such as CaSi. CaSi is predominantly known as a steel deoxidizing and desulphurizing agent. CaSi has also been used as an innoculation agent in the production of GGL (cast iron with lamellar graphite). This last-mentioned usage, however, is not very widespread as calcium forms into slag. In the present invention, CaSi is used as a sulphur stabilizing agent.

In the present invention, an iron melt is treated with metallic magnesium produced in a converter of the type used in the +GF+ pure magnesium converter process. MgS oxidizes with atmospheric oxygen to form MgO freeing the sulfur in accordance with the following equation:

$$2(MgS)+O_2=2(MgO)+2\{S\}.$$

When CaSi is added during the emptying of the converter contents including the slag, CaSi dissociates and reacts with the MgS to form CaS+Mg.

Thus, the sulphur part of the unstable compound MgS combines with calcium and remains in the slag. In this process, only calcium is active, while Si serves as a carrier element. The Si also helps to lower the high steam pressure which occurs at high converter temperatures when pure calcium is introduced.

With this process, resulphurization is substantially prevented. Additionally, the slag can remain on the surface of the melt. Because of the heat-insulating effect of the slag, longer standing times are acceptable.

There is a further advantage from the innoculation effect provided by CaSi. In the form used, this compound normally contains small amounts of Al, the maximum amount of Al being about 2% by weight. When CaSi is introduced into the melt, the Al is freed and provides a nucleating effect.

In addition to CaSi, the following stabilizing agents are suitable as additives: a mixture of calcium-cerium-magnesium fluoride; calcium metal; and a mixture of calcium-calcium aluminate-calcium chloride-slag. Desirably, CaSi and these other additives are added to the iron melt in an amount ranging from 0.05–1% by weight of the liquid iron.

In the CaSi compounds, the calcium content is variable. Because of the price-efficiency ratio, calcium silicon having a 30% calcium content is the preferred additive. Resulphurization is reduced to a maximum of 0.006–0.008% within 30 minutes with the use of this additive.

While the invention has been described by reference to specific embodiments, this was for purposes of illustration only and should not be construed to limit the spirit or the scope of the invention.

What is claimed is:

1. A process for the production of cast iron containing spheroidal graphite, comprising adding metallic magnesium to a pool of molten iron having sulfur therein to form molten cast iron containing spheroidal graphite and a slag containing magnesium sulphide, and thereafter adding a sulfur stabilizing agent to said slag to convert said magnesium sulphide in said slag to a thermodynamically more stable sulphide compound, whereby resulphurization of said cast iron is prevented.

2. The process of claim 1 wherein said thermodynamically more stable sulphide compound is selected from the group consisting of calcium sulphide and cerium sulphide.

3. The process of claim 1 wherein said sulphur stabilizing agent is a calcium-containing substance.

4. The process of claim 1 wherein said sulphur stabilizing agent is calcium silicon.

5. The process of claim 1 wherein said sulphur stabilizing agent is a calcium-cerium-magnesium fluoride mixture.

6. The process of claim 5 wherein said sulphur stabilizing agent is calcium metal.

7. The process of claim 1 wherein said sulphur stabilizing agent is a calcium-calcium aluminate-calcium chloride-slag mixture.

8. The process of claim 1 wherein said sulphur stabilizing agent is added in an amount of from 0.05–1% by weight of the molten iron.

9. The process of claim 1 wherein said pool of molten iron is contained within a converter and said sulphur stabilizing agent is added to said pool during its discharge from said converter.

* * * * *